US010566732B2

(12) United States Patent
Oishi et al.

(10) Patent No.: US 10,566,732 B2
(45) Date of Patent: Feb. 18, 2020

(54) WATERPROOF CONNECTOR STRUCTURE AND METHOD FOR PRODUCING CONNECTOR HOUSING

(71) Applicants: YAZAKI CORPORATION, Tokyo (JP); HONDA MOTOR CO., LTD., Tokyo (JP)

(72) Inventors: Kozo Oishi, Tochigi (JP); Tomoyuki Miyakawa, Tochigi (JP); Kazuyuki Ochiai, Saitama (JP); Daisuke Fujihira, Saitama (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/219,869

(22) Filed: Dec. 13, 2018

(65) Prior Publication Data

US 2019/0115688 A1 Apr. 18, 2019

Related U.S. Application Data

(63) Continuation of application No. PCT/JP2017/011887, filed on Mar. 23, 2017.

(30) Foreign Application Priority Data

Jun. 15, 2016 (JP) ..... 2016-118789

(51) Int. Cl.
*H01R 13/52* (2006.01)
*H01R 43/18* (2006.01)
(Continued)

(52) U.S. Cl.
CPC ..... *H01R 13/5219* (2013.01); *H01R 13/5216* (2013.01); *H01R 13/631* (2013.01);
(Continued)

(58) Field of Classification Search
CPC ..... H01R 13/5219; H01R 13/5216; H01R 13/631
(Continued)

(56) References Cited

U.S. PATENT DOCUMENTS 3,124,405 A 3/1964 Massa
3,199,060 A 8/1965 Marasco
(Continued)

FOREIGN PATENT DOCUMENTS

EP 0 730 322 A1 9/1996
JP 49-124589 U 10/1974
(Continued)

OTHER PUBLICATIONS

English language Written Opinion of the International Search Report for PCT/JP2017/011887 dated Jun. 13, 2017.
(Continued)

*Primary Examiner* — Alexander Gilman
(74) *Attorney, Agent, or Firm* — Kenealy Vaidya LLP

(57) ABSTRACT

There is provided a waterproof connector structure which includes a pair of connector housings. An opening end portion of a cylindrical body of one connector housing is inserted into an opening end portion of a cylindrical body of another connector housing at the time of fitting. One cylindrical body has a projection part which is provided to protrude outward in a radial direction from the opening end portion thereof entirely in a circumferential direction. The projection part is provided on a front side in a fitting direction from an opening part of a terminal receiving chamber surrounded by the one cylindrical body.

5 Claims, 7 Drawing Sheets

(51) Int. Cl.
*H01R 43/00* (2006.01)
*H01R 13/631* (2006.01)
*H01R 13/64* (2006.01)
*H01R 103/00* (2006.01)

(52) U.S. Cl.
CPC ..... *H01R 13/64* (2013.01); *H01R 43/005* (2013.01); *H01R 43/18* (2013.01); *H01R 2103/00* (2013.01)

(58) Field of Classification Search
IPC ..... H01R 13/52
See application file for complete search history.

(56) References Cited

U.S. PATENT DOCUMENTS 3,474,386 A 10/1969 Link
3,880,487 A * 4/1975 Goodman ..... H01R 13/50 439/282
4,614,392 A * 9/1986 Moore ..... H01R 13/5213 174/91
4,986,764 A * 1/1991 Eaby ..... H01R 13/53 439/275
5,580,266 A * 12/1996 Shelly ..... H01R 13/53 439/281
5,626,486 A * 5/1997 Shelly ..... H01R 13/53 439/273
6,336,821 B1 * 1/2002 Hattori ..... H01R 13/17 439/282
8,337,240 B2 * 12/2012 Feldmeier ..... H01R 13/04 439/488
9,755,352 B2 * 9/2017 Hamada ..... H01R 24/20
9,831,595 B2 * 11/2017 Hamada ..... H01R 13/5219
2017/0062978 A1 * 3/2017 Seido ..... H01R 13/631

FOREIGN PATENT DOCUMENTS

JP 3-22366 U 3/1991
JP 4-112473 U 9/1992
JP 2011-119073 A 6/2011
JP 2013-229166 A 11/2013
JP 2013-229168 A 11/2013
JP 2013-239367 A 11/2013
JP 2013-239370 A 11/2013
JP 5818100 B2 11/2015
JP 5852296 B1 2/2016
WO 2013/161337 A1 10/2013

OTHER PUBLICATIONS

The extended European search report for the related European Patent Application No. 17812967.2 dated Apr. 12, 2019.
International Search Report and Written Opinion of the International Search Report for PCT/JP2017/011887 dated Jun. 13, 2017.

* cited by examiner

WATERPROOF CONNECTOR STRUCTURE AND METHOD FOR PRODUCING CONNECTOR HOUSING

CROSS-REFERENCES TO RELATED APPLICATIONS

This application is a continuation of International Application No. PCT/JP2017/011887, which was filed on Mar. 23, 2017 based on Japanese Patent Application (No. 2016-118789) filed on Jun. 15, 2016, the contents of which are incorporated herein by reference.

TECHNICAL FIELD

The present invention relates to a waterproof connector structure and a method for producing a connector housing.

BACKGROUND ART

In the related art, in an automobile or the like, in some cases, electric wires are connected by using a connector (hereinafter referred to as "a waterproof connector".) excellent in a waterproof property. For example, a waterproof connector structure is known which includes a female connector which has a cylindrical inner housing formed with a cavity (terminal receiving chamber) which can receive a female terminal and a cylindrical outer housing which surrounds the inner housing, and a male connector which has a cylindrical housing formed with a cavity (terminal receiving chamber) which can receive a male terminal, wherein both connectors are fitted such that the housing of the male connector is inserted into a gap between the inner housing and the outer housing of the female connector.

An annular rubber packing is mounted on the outer circumferential surface of the inner housing of the female connector, and when both connectors are fitted, the housing of the male connector is inserted into the gap of the female connector. Further, the packing is brought into close contact with the outer circumferential surface of the inner housing of the female connector and with the inner circumferential surface of the housing of the male connector, so as to block the gap, and thus, which prevents water from entering the opening of the cavity of both housings.

However, an annular space for mounting the packing in the female connector is required in this waterproof structure, whereby the female connector (and also the waterproof structure) is larger compared to the case of the connector which does not require such a space.

On the other hand, in JP-A-2013-229168, a waterproof structure which does not use the packing is described in which an annular seal plate having an elasticity is provided in the female housing, and a cylinder tip of the male housing is pushed to the seal plate at the time of fitting the female housing and the male housing. Accordingly, entry of the water through between the female housing and the male housing is prevented (for example, see JP-A-2013-229168).

SUMMARY

However, in the waterproof structure described in JP-A-2013-229168, for example, in a case where a dimension error occurs in at least one of the both housings, a pressure force according to the seal plate may be decreased to deteriorate a waterproof performance. In addition, in order to secure a desired sealability, the seal plate is necessarily pressed sufficiently by the cylinder tip of the male housing, and a large insertion force (pressing force) is required to press the male housing to the set position of the female housing.

The invention has been made in consideration of the above-described situation, and an object thereof is to provide a waterproof connector structure in which an insertion force at the time of inserting one of both housings to the other can be reduced, and a waterproof performance can be secured excellently and a method for producing the housing used in such waterproof structure.

In order to achieve the above-described object, "a waterproof structure" according to an aspect of the present invention is characterized by the following (1) and (2).

(1) A waterproof connector structure including: a pair of connector housings fittable to each other and capable of preventing water from entering a terminal receiving chamber through an opening part on a front side of the terminal receiving chamber of the connector housing in a fitting direction at a time of fitting the pair of connector housings, wherein each of the pair of connector housings includes a cylindrical body which surrounds the opening part and in which a front side in the fitting direction is opened, and is configured such that an opening end portion of one cylindrical body is inserted into an opening end portion of another cylindrical body at the time of fitting the pair of connector housings, and wherein the one cylindrical body includes a projection part which is provided on the opening end portion of the one cylindrical body entirely in a circumferential direction to protrude outward from the opening end portion of the one cylindrical body in a radial direction so as to contact the opening end portion of the another cylindrical body, the projection part being provided on the front side in the fitting direction from the opening part of the terminal receiving chamber surrounded by the one cylindrical body.

(2) The waterproof connector structure according to (1), wherein the projection part has a semi-arc shape or a trapezoidal shape in a cross-section perpendicular to the fitting direction.

According to the waterproof structure configured as (1), one (inner) cylindrical body is fitted to another (outer) cylindrical body at the time of engaging the connector housings to each other, so as to achieve certain waterproof. Particularly, the projection part which is provided in the fitting surface (outer circumferential surface) of one (inner) cylindrical body contacts the fitting surface (inner circumferential surface) of the other (outer) cylindrical body, so that the cylindrical bodies can be brought into close contact with each other within the elastic limit, and thus, it is possible to secure an excellent waterproof performance. In addition, when the cylindrical bodies are brought into close contact with each other within the elastic limit, even in a case where a dimension error occurs in the cylindrical body, the dimension error, if it is within the elastic deformation of the cylindrical body can be absorbed, and thus, it is possible to maintain an excellent waterproof performance.

Since one (inner) cylindrical body contacts the other (outer) cylindrical body through the projection part, the friction resistance at the time of fitting can be reduced compared to a case where the fitting surfaces of the cylindrical body are brought into surface contact with each other, and thus, it is possible to reduce the insertion force at the time of inserting one of both connector housings to the other.

The cylindrical body is formed integrally in each of both connector housings, and thus it becomes unnecessary to use a rubber packing or the like which is used in the waterproof structure according to JP-A-2013-229168. Thus, the space for receiving the rubber packing or the like is not required, and the connector can be reduced in size.

In a case where a gap between the fitting surfaces of the cylindrical bodies is sealed, as the distance between the projection part protruding from one (inner) cylindrical body and the opening end portion of the cylindrical body is larger (the projection part is arranged closer to the root side (that is, to the position close to the opening part of the terminal receiving chamber) of the cylindrical body), the contact point between the other (outer) cylindrical body and the projection part is positioned on the tip side of the other (outer) cylindrical body. In other words, the distance between the water stopping position and the opening surface of one (inner) cylindrical body is lengthened (entry of the water from the outside can be stopped at the position apart from the opening surface), and the waterproof property is improved to such an extent. However, in a case where the projection part of one (inner) cylindrical body is arranged on the root side, it is necessary to consider following points when the extraction is performed from the mold at the time of resin-molding.

Typically, the mold for resin-molding one (inner) cylindrical body (housing) has a mold component (insert) which forms the inner wall of the cylindrical body and a mold component (insert) which surrounds the cylindrical body to form an outer wall. An annular recess part for forming the projection part is formed in the insert which forms the outer wall. In that case, in a state where the projection part is received by the recess part, when the molded body is extruded outward from the mold, there is a possibility that the projection part is caught by the recess part so that the shape of the projection part is deformed. In this regard, a method is considered as follows. First of all, the insert of the mold which forms the inner wall of the cylindrical body is pulled out from the cylindrical body such that the inside of the cylindrical body is formed to be caved. In that state, by extruding the cylindrical body, the cylindrical body is bent to the inside, and the projection part is extracted from the recess part of the mold. However, as the cylindrical body is closer to the root side, the bending amount to the inside is smaller. Thus, there is a possibility that the projection part cannot be extracted completely from the recess part of the mold when the projection part is positioned close to the root of the cylindrical body.

In this regard, in the waterproof structure having this configuration, the projection part is provided on the front side in the fitting direction from the opening part of the terminal receiving chamber which one (inner) cylindrical body surrounds. Accordingly, in the cylindrical body, a member (specifically, a wall surface or the like provided with the opening part of the terminal receiving chamber) which obstructs that the cylindrical body in the mold is bent inward is not provided from the position where the projection part is provided to the tip (opening end) of the cylindrical body. Thus, it is possible to increase the bending amount of the cylindrical body to the inside. Therefore, although the projection part is positioned close to the root of the cylindrical body, the projection part can be extracted from the recess part of the mold, and it is possible to prevent the projection part from being broken when the molded body is extracted from the mold. Accordingly, it is possible to further improve the waterproof performance at the time of fitting the pair of cylindrical bodies.

Incidentally, preferably, the projection part is provided a predetermined set dimension apart from the wall surface or the like provided with the opening part of the terminal receiving chamber to the front side in the fitting direction. Herein, the set dimension indicates such a distance that allows the projection part to be deviated from the recess part of the mold, which forms the projection part by the cylindrical body being bent inward when the insert of the mold which forms the outer wall of the cylindrical body is extracted from the mold in a state where the insert of the mold which forms the inner wall of the cylindrical body is pulled out from the cylindrical body with holding the connector housing in the mold. Specifically, the set dimension can be decided on the basis of at least one selected from the height of the projection part, the shrinkage amount of the projection part, the thickness of the cylindrical body, the diameter dimension of the cylindrical body, or the like.

According to the waterproof structure configured as (2), the projection part has a sectional surface which is orthogonal to the fitting direction and has a semi-arc shape or a trapezoidal shape. Accordingly, the projection part is easily deviated from the recess part of the mold. Thus, the breakage of the projection part can be prevented more reliably.

In order to achieve the above-described object, "a method for producing a connector housing" according to another aspect of the present invention is characterized by the following (3).

(3) A method for producing a connector housing including a terminal receiving chamber, the connector housing including a cylindrical body which surrounds an opening part of the terminal receiving chamber, and the cylindrical body including a projection part which is provided on an opening end portion of the cylindrical body entirely in a circumferential direction to protrude outward from the opening end portion of the cylindrical body in a radial direction, the projection part being provided on an opening end side from the opening part of the terminal receiving chamber, the production method including:

a first process of filling a resin into a mold and curing a molded body of the connector housing;

a second process of extracting a first mold component which forms an inner wall of the cylindrical body of the molded body from the molded body while holding the molded body in the mold;

a third process of extracting a second mold component which forms an outer wall including the projection part of the cylindrical body of the molded body from the molded body while holding the molded body in the mold; and a fourth process of releasing the molded body from the mold.

According to the producing method configured as (3), the connector housing can be produced without the deformation of the shape of the projection part.

According to the invention, it is possible to provide a waterproof connector structure in which an insertion force at the time of inserting one of both housings to the other can be reduced and a waterproof performance can be secured excellently, and a method for producing a connector housing having such a waterproof structure.

BRIEF DESCRIPTION OF THE DRAWINGS

FIGS. 9A and 9B are views illustrating an operation to extract a molded body from a mold, in which FIG. 9A illustrates an example to which this embodiment is applied, and FIG. 9B illustrates a comparative example.

DETAILED DESCRIPTION

Hereinafter, an embodiment of a waterproof connector structure according to the invention will be described with reference to FIGS. 1 to 8. This embodiment is described by using a water-proof type connector mounted in an automobile or the like as an example. The waterproof connector structure of the invention can be applied to connectors for various uses.

Figure 1:
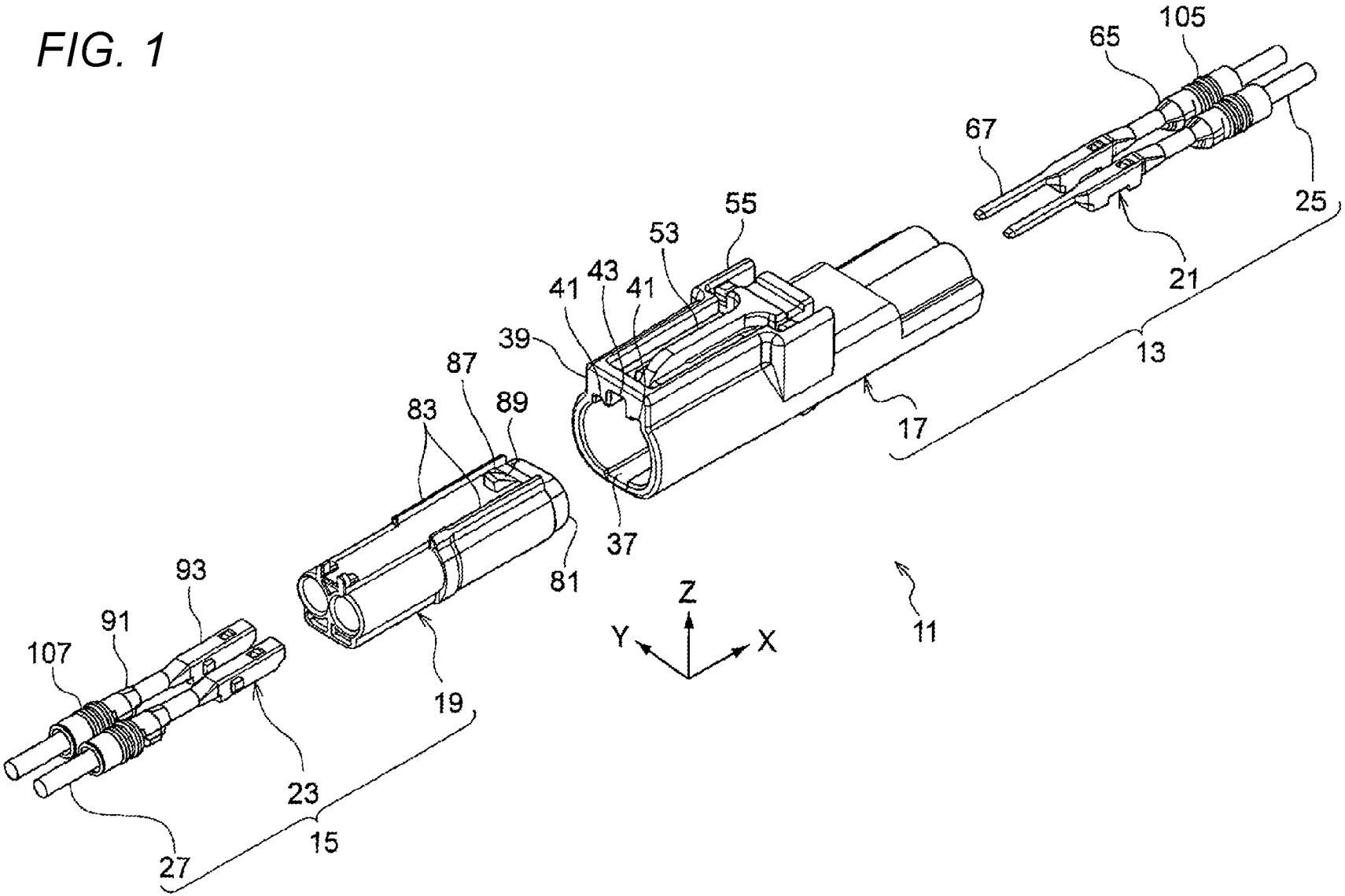
FIG. 1 is an exploded perspective view illustrating a connector to which a waterproof connector structure according to the invention is applied.
Figure 2:
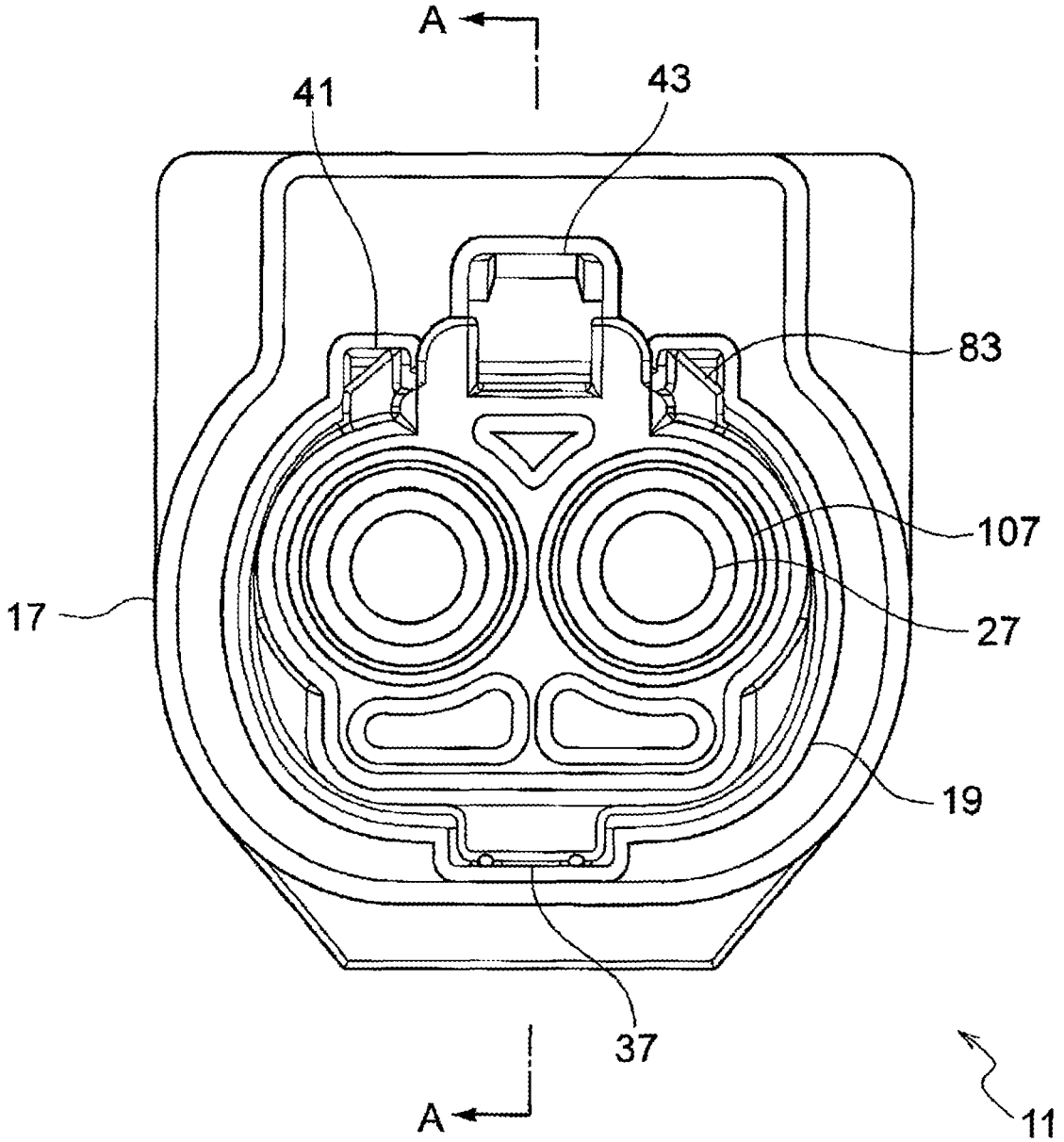
FIG. 2 is a back view illustrating the connector of FIG. 1 when viewed from a rear side of a female connector.

As illustrated in FIGS. 1 and 2, a connector 11 of this embodiment is configured by a male connector 13 and a female connector 15, and a male housing 17 of the male connector 13 and a female housing 19 of the female connector 15 are fitted (engaged) to each other so that male terminals 21 received by the male housing 17 and female terminals 23 received by the female housing 19 are connected electrically. An electric wire 25 is connected with the male terminal 21, and an electric wire 27 is connected with the female terminal 23. The female housing 19 is fitted into the male housing 17 so as to be locked. FIG. 1 illustrates an example in which two terminals are received by each of the male connector 13 and the female connector 15. However, the number of the received terminals is not limited to two. Incidentally, in the following description, an X direction of FIG. 1 is defined as a front and rear direction, a Y direction is defined as a width direction, a Z direction is defined as a height direction, a fitting direction of the connectors is defined as a front side, and an upper side of FIG. 1 is defined as an upper direction.

Figure 3:
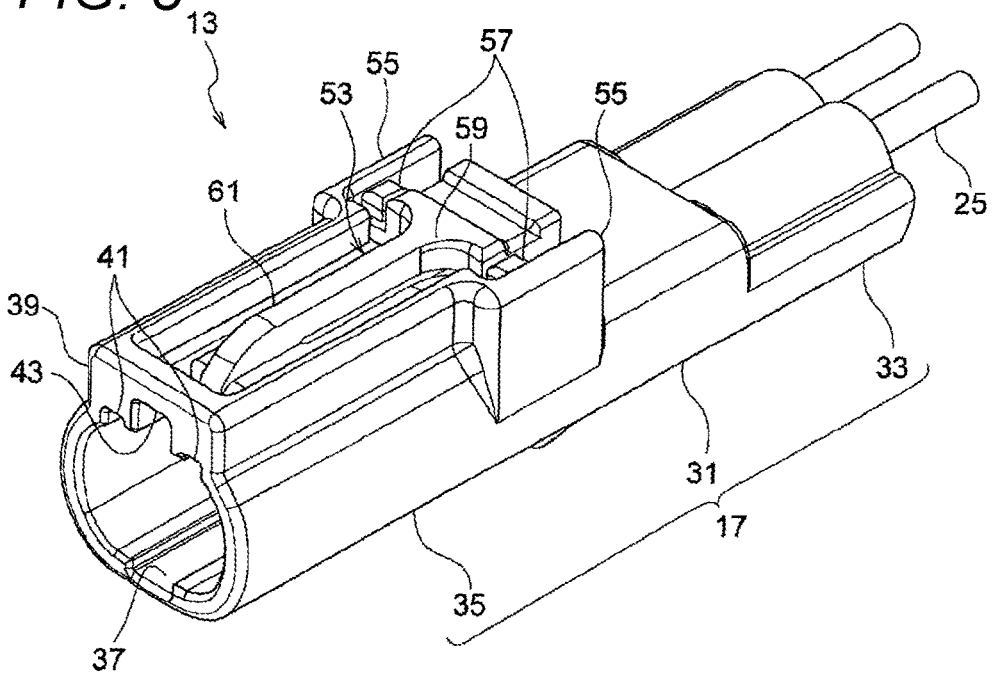
FIG. 3 is a perspective view of an appearance of a male connector.
Figure 6:
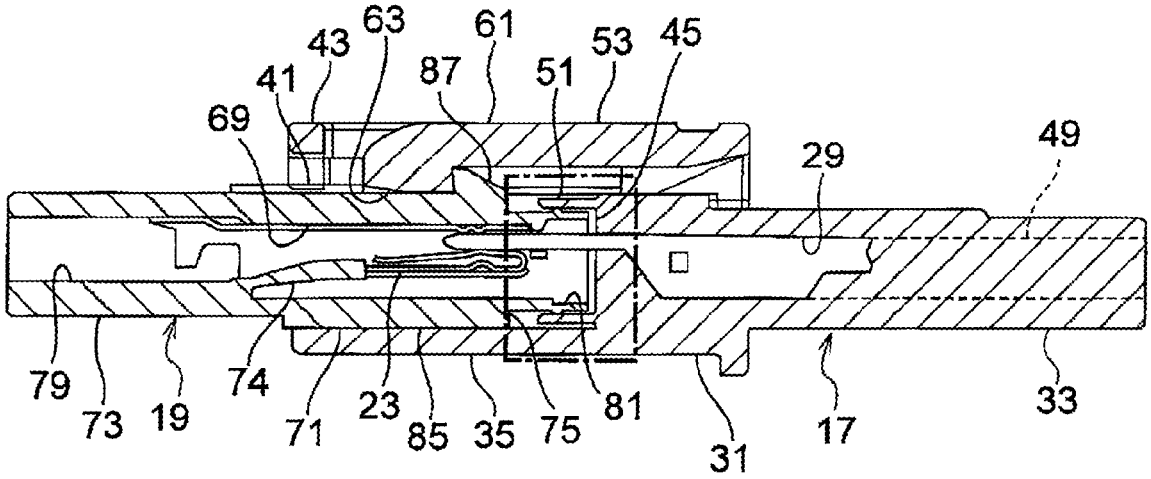
FIG. 6 is a sectional view taken along a direction of arrow A-A of FIG. 2 and illustrates a fitting state of the male connector and the female connector.

The male connector 13 has the male housing 17 which is formed by an insulation synthetic resin to have a cylindrical shape and the male terminal 21 which is received in the male housing 17 from the rear side. As illustrated in FIGS. 3 and 6, in the male housing 17, a cylindrical base part 31 in which a male terminal receiving chamber 29 (cavity) which receives the male terminal 21 is formed, a wire holding part 33 which protrudes from the base part 31 to the rear side, and a hood part 35 which protrudes from the base part 31 to the front side are formed integrally. The hood part 35 has a circumferential wall which is continuous to a circumferential wall of the base part 31, and is formed in cylindrical shape whose a sectional surface orthogonal to an axial direction is a shape of elliptise with the width direction as the major axis.

A guide groove 37 which extends in the axial direction is formed in the inner wall of the hood part 35. A pair of first notch parts 41 and a second notch part 43 which is formed inside the first notch parts 41 are formed in a wall part 39 which stands to flush with the front end surface of the hood part 35.

Figure 4:
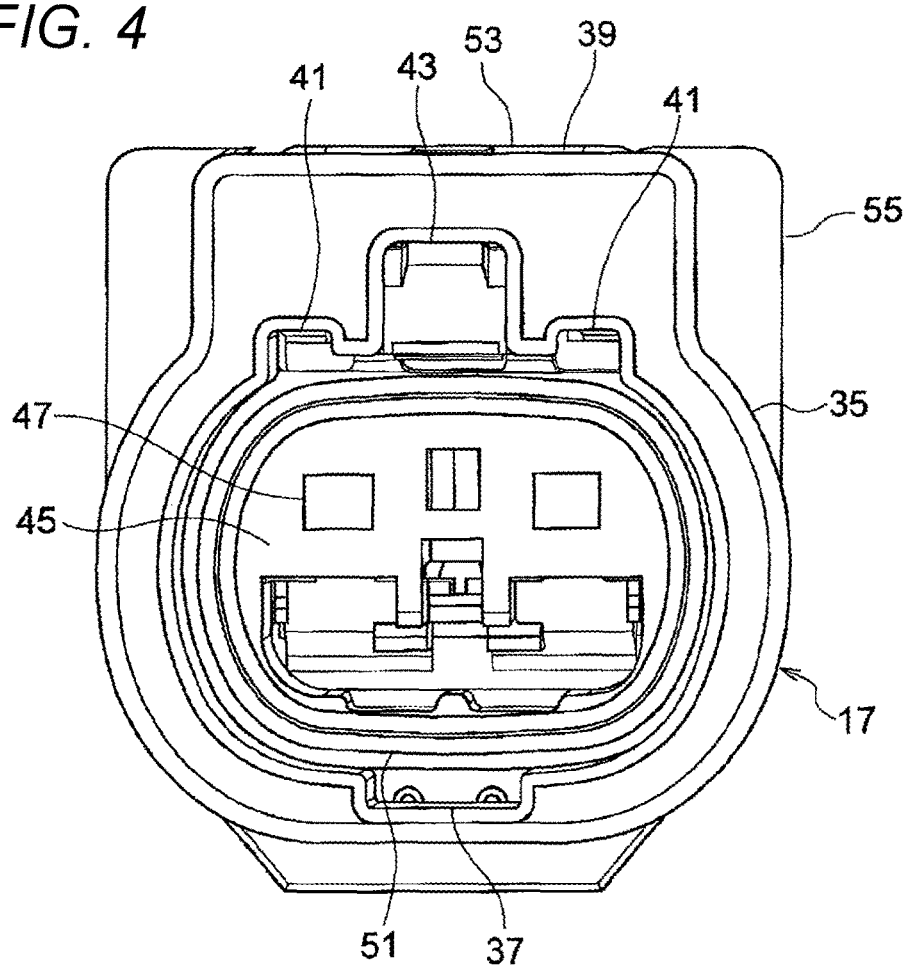
FIG. 4 is a front view illustrating a male housing of the male connector when viewed from a front side.

Two male terminals 21 are partitioned by a partition wall (not illustrated) to be received by the male terminal receiving chamber 29 and are held in a set position by engaging a lance (not illustrated) which extends to the inside of the male terminal receiving chamber 29 with each of the male terminals 21. As illustrated in FIGS. 4 and 6, the male terminal receiving chamber 29 is formed to allow an opening 47 which is open in the front end surface 45 of the base part 31 surrounded by the hood part 35 to communicate with a through hole 49 which penetrates the wire holding part 33 in the axial direction. A cylindrical male-side cylindrical body 51 (outer cylindrical body) which protrudes from the periphery of the opening 47 of the base part 31 to the front side to surround the opening 47 is formed integrally in the hood part 35.

As illustrated in FIG. 3, the male housing 17 has a lock arm 53 which extends in a cantilever shape to the front side of the axial direction. The lock arm 53 has two leg parts 57 which are respectively supported by a pair of wall parts 55 standing from both side surfaces of the base part 31 in the width direction, a base end part 59 which connects the leg parts 57 in the width direction, and an arm part 61 which extends to the front side from the central portion of the base end part 59 in the width direction.

In the lock arm 53, the front end portion of the arm part 61 can be displaced to the upper side with respect to the horizontal direction with the base end part 59 as a fulcrum. As illustrated in FIG. 6, a lock part 63 which protrudes downward is provided in the front-end lower portion of the arm part 61. As illustrated in FIG. 3, the pair of wall parts 55 are provided from the base part 31 of the male housing 17 over the wall part 39 of the hood part 35 to surround the lock arm 53. The upper end surface of the lock arm 53 is set to have the same height or a lower height compared to the upper end surface of the wall parts 39 and 55.

As illustrated in FIG. 1, the male terminal 21 is formed of a conductive metal plate material or the like, and is formed integrally with a wire connection part 65 which crimp-connects the core wire of the wire 25 and a male tap 67 which is connected with the female terminal 23. The male tap 67 is formed to have a rod shape extending in the front and rear direction. In a state where the male terminal 21 is held at the set position of the male terminal receiving chamber 29, the male tap 67 protrudes from the front end surface 45 of the base part 31 and extends to the front side from the front end of the male-side cylindrical body 51.

Figure 5:
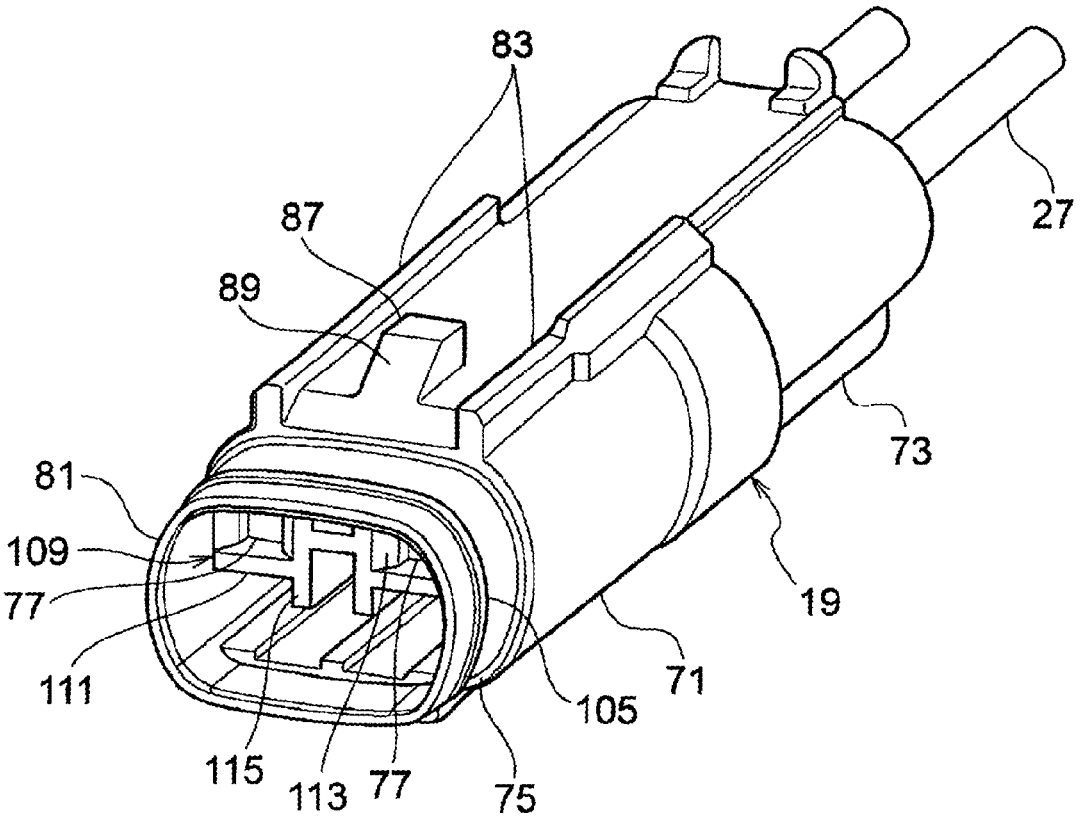
FIG. 5 is a perspective view of an appearance of the female connector.

As illustrated in FIG. 1, the female connector 15 has the female housing 19 which is formed by an insulating synthetic resin to be cylindrical and the female terminal 23 which is received from the rear side in the female housing 19. As illustrated in FIGS. 5 and 6, the female housing 19 has its sectional surface orthogonal to the axial direction is formed to have a shape substantially similar to the inner circumferential surface of the hood part 35 of the male housing 17, and is integrally formed with a base part 71 in which two female terminal receiving chambers (cavity) 69 into which the female terminals 23 are inserted are formed and a wire holding part 73 which protrudes from the base part 71 to the rear side. The female terminal receiving chamber 69 is formed such that two female terminals 23 are partitioned by a partition wall (not illustrated), and a lance 74 which extends to the inside of the female terminal receiving chamber 69 is engaged with each of the female terminals 23 to hold the female terminals 23 at the set position.

As illustrated in FIGS. 5 and 6, the female terminal receiving chamber 69 is formed to allow an opening 77 into which the male tap 67 is inserted to communicate with a through hole 79 which penetrates the wire holding part 73 in the axial direction. A cylindrical female-side cylindrical body 81 (inner cylindrical body) which surrounds the opening 77 and protrudes to the front side from the front end surface 75 of the base part 71 is formed integrally in the base part 71. In this embodiment, the opening 77 is positioned in the female-side cylindrical body 81 on the front side from the front end surface 75 of the base part 71. However, the opening 77 may be arranged in the front end surface 75 surrounded by the female-side cylindrical body 81.

The female housing 19 is provided with a pair of protrusion parts 83 (FIG. 5) which extend from the upper surface of the base part 71 in the axial direction and a stepped part 85 (FIG. 6) which extends from the lower surface of the base part 71 in the axial direction. The pair of protrusion parts 83 are provided apart in the width direction and each can abut on the inner circumferential surface of the male housing 17. A locking part 87 which protrudes upward is provided inside the pair of protrusion parts 83. The locking part 87 is provided with an inclined surface 89 which is inclined downward toward the base part 71 on the front side, and the lock arm 53 of the male housing 17 is pushed upward along the inclined surface 89 at the time of fitting the both housings.

As illustrated in FIG. 1, the female terminal 23 is formed of a conductive metal plate material or the like, and is formed integrally with a wire connection part 91 which crimp-connects the core wire of the wire 27 and a rectangular and cylindrical electric contact part 93 in which the male tap 67 of the male terminal 21 is inserted and connected. In the electric contact part 93, a tip part is provided to be positioned to flush with the opening 77 of the base part 71 or to be retreated by a set distance from the opening 77 in a state where the female terminal 23 is held at the set position of the female terminal receiving chamber 69.

Figure 7:
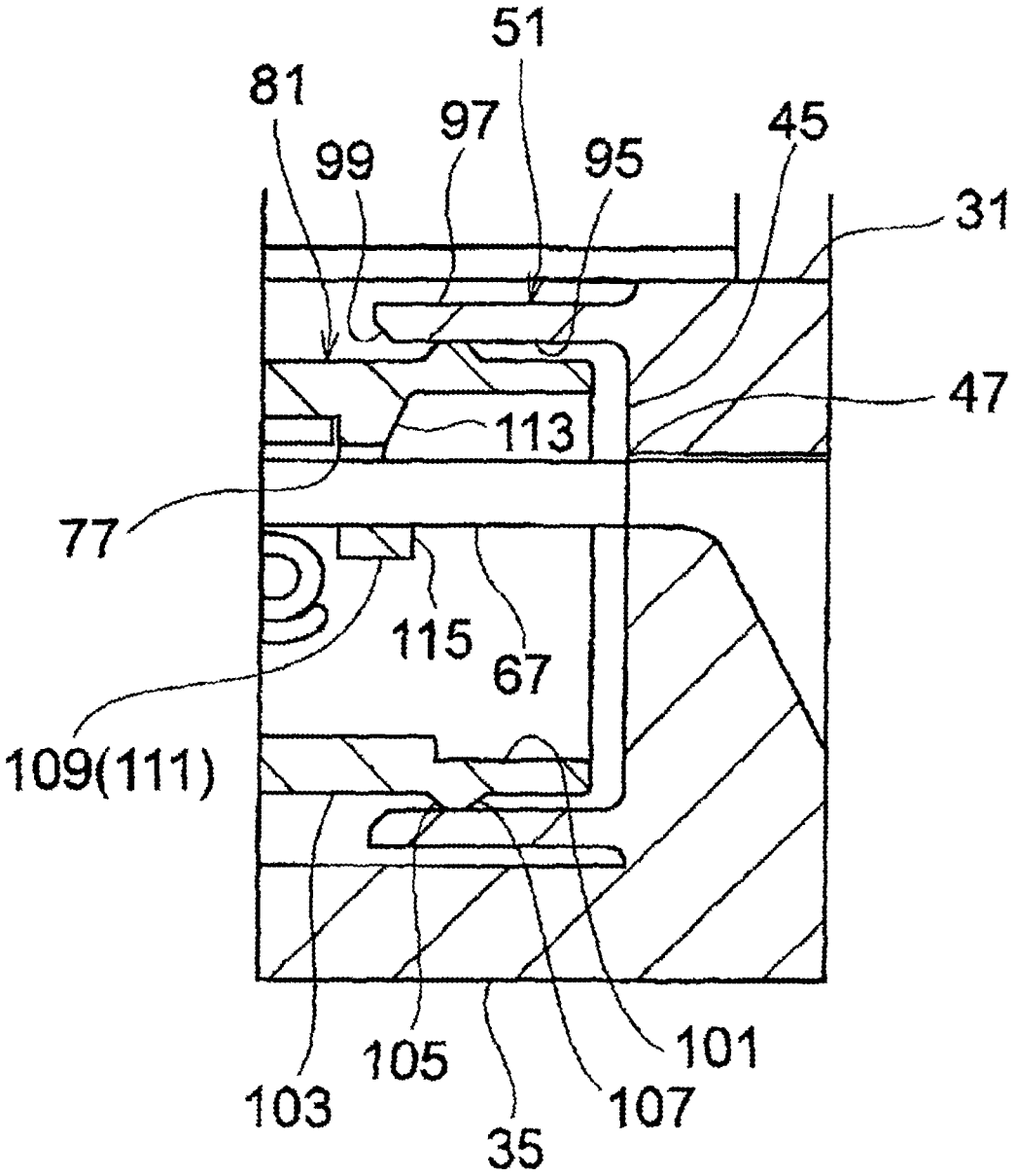
FIG. 7 is an enlarged view of a frame inside of FIG. 6.

Next, the characteristic configuration of this embodiment will be described. In this embodiment, at the time of fitting the male housing 17 and the female housing 19, the female-side cylindrical body 81 is fitted into the male-side cylindrical body 51. As illustrated in FIG. 7, the male-side cylindrical body 51 is a resin member which extends in a cylindrical shape from the periphery of the opening 47 of the base part 31 of the male housing 17 to the front side. The male-side cylindrical body 51 has a rigidity lower than that of the female-side cylindrical body 81 and a relatively excellent elasticity. The male-side cylindrical body 51 is formed to have a cylindrical shape whose sectional surface orthogonal to the axial direction of the male housing 17 is substantially a shape of ellipse with the width direction as the major axis. The male-side cylindrical body 51 has an inner circumferential surface 95 (fitting surface) and an outer circumferential surface 97 which extend in the axial direction of the male housing 17, and is set to have an almost uniform thickness in the axial direction. An inclined surface 99 which is widened to the front side is formed in the tip inner circumferential surface of the male-side cylindrical body 51. The inclined surface 99 has a function to guide the female-side cylindrical body 81 into the male-side cylindrical body 51.

The female-side cylindrical body 81 is a resin member which extends in a cylindrical shape from the periphery of the opening 77 of the base part 71 of the female housing 19 to the front side, and has a rigidity higher than that of the male-side cylindrical body 51. The female-side cylindrical body 81 has an inner circumferential surface 101 and an outer circumferential surface 103 (fitting surface) which extend in the axial direction of the female housing 19, and the sectional surface orthogonal to the axis of the female housing 19 is formed in a cylindrical shape substantially similar to the inner circumferential surface 95 of the male-side cylindrical body 51. The protruding amount of the female-side cylindrical body 81 from the front end surface 75 is set to be shorter than that of the male-side cylindrical body 51 from the front end surface 45.

A projection 105 which contacts the inner circumferential surface 95 of the male-side cylindrical body 51 is provided over the entire circumference of the outer circumferential surface 103 of the female-side cylindrical body 81. The projection 105 is set to have such a height that, when the female-side cylindrical body 81 is fitted to the male-side cylindrical body 51, it can contact the inner circumferential surface 95 of the male-side cylindrical body 51 to press the entire circumference of the inner circumferential surface 95. In the projection 105, the sectional surface in the axial direction of the female-side cylindrical body 81 is formed in a trapezoidal shape, and an inclined surface 107 is formed which is inclined toward the outer circumferential surface 103 on the front side. The inclined surface 107 has a function to contact the inclined surface 99 of the male-side cylindrical body 51 and guide the male-side cylindrical body 51 to the top portion of the projection 105.

Figure 8:
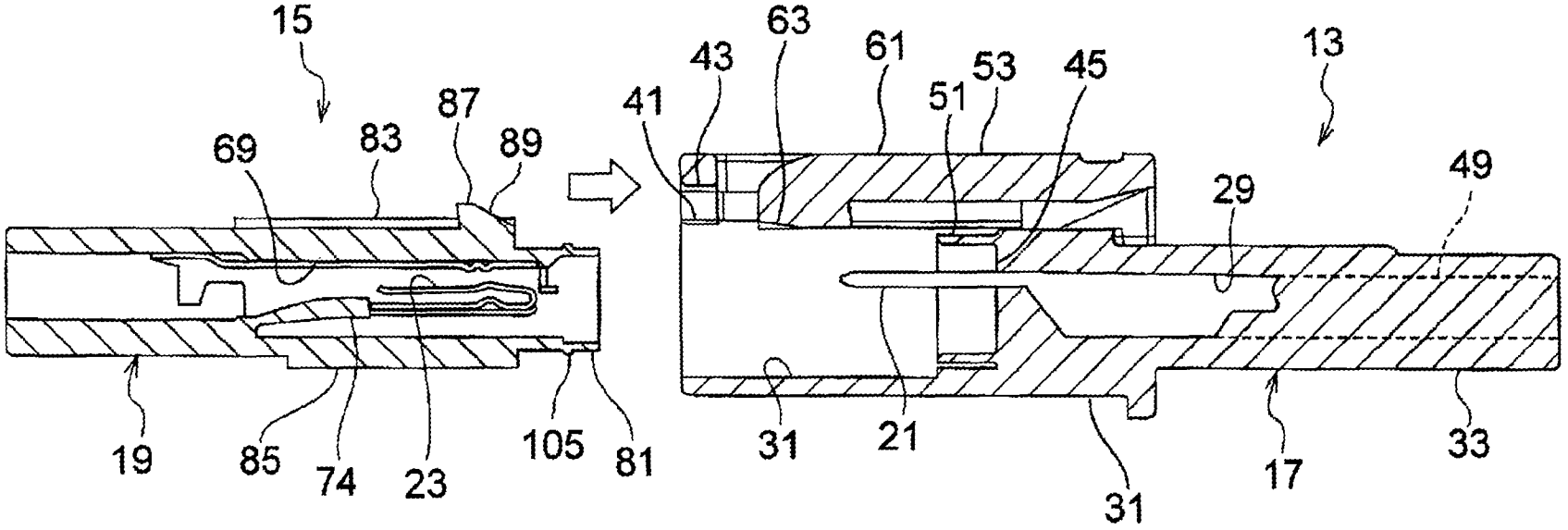
FIG. 8 is a view illustrating a state before the male connector and the female connector are fitted in FIG. 6.

Next, an assembly method of the both housings and the operation at the time of fitting are described. First, as illustrated in FIG. 1, an annular rubber plug 105 is mounted on the outer circumferential surface of the wire 25 connected in the male terminal 21. Further, the male terminal 21 is inserted into the male terminal receiving chamber 29 of the male housing 17 from the rear side, and the rubber plug 105 is inserted into the through hole 49 of the wire holding part 33. Accordingly, the opening of the through hole 49 is sealed by the wire 25 and the rubber plug 105. Similarly, an annular rubber plug 107 is mounted on the outer circumferential surface of the wire 27 connected with the female terminal 23, the female terminal 23 is inserted to the female terminal receiving chamber 69 of the female housing 19 from the rear side, and the rubber plug 107 is inserted into the through hole 79 of the wire holding part 73. Accordingly, the opening of the through hole 79 is sealed by the wire 27 and the rubber plug 107. In that state, as indicated by the arrow of FIG. 8, the male connector 13 and the female connector 15 come relatively close, and the female housing 19 is inserted to the male housing 17.

When the female housing 19 is inserted into the male housing 17, the pair of protrusion parts 83 (FIG. 5) of the female housing 19 pass through the first notch parts 41 (FIG. 3) of the male housing 17, respectively, and at the same time the locking part 87 (FIG. 5) of the female housing 19 passes through the second notch part 43 (FIG. 3) of the male housing 17. In addition, the stepped part 85 (FIG. 6) of the female housing 19 is guided along the guide groove 37 (FIG. 3) of the male housing 17.

When the insertion of the female housing 19 progresses, the lock arm 53 of the male housing 17 rides on the locking part 87 along the inclined surface 89 of the locking part 87 of the female housing 19, and the arm part 61 is deformed to be bent upward. Then, the lock part 63 of the arm part 61 rides over the locking part 87, and the arm part 61 returns elastically. Accordingly, the locking part 87 is locked in the lock part 63, and both housings are locked in a normal fitting state (FIG. 6).

On the other hand, when the both housings are in the normal fitting state, as illustrated in FIG. 7, the female-side cylindrical body 81 is fitted to the male-side cylindrical body 51 in the state of being inserted to the male-side cylindrical body 51, and the projection 105 of the female-side cylindrical body 81 presses the inner circumferential surface of the male-side cylindrical body 51 over the entire circumference. In the male-side cylindrical body 51, by that pressure, the tip part is deformed elastically outward in a radial direction, and the restoring force generated by the elastic deformation presses the projection 105 of the female-side cylindrical body 81. As a result, the male-side cylindrical body 51 and the female-side cylindrical body 81 elastically abut over the entire circumference through the projection 105, and the gap between the opening 47 of the male connector 13 and the opening 77 of the female connector 15 is sealed watertightly. Thus, it is possible to prevent the water from entering the male terminal receiving chamber 29 and the female terminal receiving chamber 69 through the openings 47 and 77 respectively.

In this embodiment, when the male connector 13 is fitted to the female connector 15, the projection 105 of the outer circumferential surface 103 of the female-side cylindrical body 81 can contact the inner circumferential surface 95 of the male-side cylindrical body 51, so that the cylindrical bodies can be brought into close contact with each other within the elastic limit. Thus, it is possible to secure an excellent waterproof performance. In addition, by causing the cylindrical bodies to be brought into close contact with each other within their elastic limits, even in a case where a dimension error has occurred in each of the cylindrical bodies 51 and 81, the dimension error, if it is within the elastic deformation of each of the cylindrical bodies 51 and 81 can be absorbed. Thus, it is possible to maintain an excellent waterproof performance. In addition, as the female-side cylindrical body 81 is brought into close contact with the inner circumferential surface 95 of the male-side cylindrical body 51 through the projection 105, a gap is formed in an area excluding the projection 105 between the male-side cylindrical body 51 and the female-side cylindrical body 81. Thus, although a foreign matter or the like adheres to the gap, a plastic deformation or a breakage does not occur in the cylindrical bodies 51 and 81. Further, although a distance between the male connector 13 and the female connector 15 is fluctuated by the vibration transmitted to the connector 11, the vibration can be absorbed by the male-side cylindrical body 51 and the female-side cylindrical body 81. Thus, it is possible to suppress the degradation over time in the connector 11 due to the vibration.

Since the male-side cylindrical body 51 contacts the female-side cylindrical body 81 through the projection 105, the contact area is small. Thus, it is possible to reduce a friction. Accordingly, it is possible to reduce an insertion load at the time of inserting the female housing 19 into the male housing 17 when the male housing 17 is fitted to the female housing 19.

In this embodiment, the male-side cylindrical body 51 is formed integrally with the male housing 17, and the female-side cylindrical body 81 is formed integrally with the female housing 19. Thus, it is not necessary to additionally provide a rubber packing or the like for stopping water. Accordingly, a receiving space such as the rubber packing or the like is not required, which can reduce the size of the connector 11, and the number of the components is decreased to reduce a producing cost.

Incidentally, in this embodiment, when the female housing 19 is inserted into the male housing 17, the pair of protrusion parts 83 each abut on the inner circumferential surface of the male housing 17, and the stepped part 85 is guided along the guide groove 37 of the male housing 17. Accordingly, a relative position disagreement between the male housing 17 and the female housing 19 is suppressed, and thus the female-side cylindrical body 81 can be brought into contact with the set position of the male-side cylindrical body 51. As a result, the abutment of both the cylindrical bodies 51 and 81 can be improved to reliably exhibit a desired waterproof performance.

Incidentally, in a case where a gap between the fitting surfaces of the male-side cylindrical body 51 and the female-side cylindrical body 81 is sealed, if the projection 105 which protrudes from the outer circumferential surface 103 of the female-side cylindrical body 81 is positioned on the root side of the female-side cylindrical body 81, the projection 105 contacts the tip of the male-side cylindrical body 51. Thus, the distance between the water stopping position and each of the openings 47 and 77 is lengthened, and the waterproof property is improved to such an extent. However, in a case where the projection 105 of the female-side cylindrical body 81 is positioned to the root side, there is a concern that, when the female-side cylindrical body 81 is resin-molded, it is difficult to release the female-side cylindrical body 81 from the mold when the female-side cylindrical body 81 is extracted from the mold.

With respect thereto, as illustrated in FIG. 7, in this embodiment, the projection 105 is provided on the front end (tip) side of the female-side cylindrical body 81 from a structural member (member) 109 which is supported in the inner wall of the female-side cylindrical body 81 to form the opening 77 of the female terminal receiving chamber 69.

As illustrated in FIG. 5, the structural member 109 has a frame body 111 which defines two openings 77 arranged to be separated in the width direction, and is supported in the inner wall of the female-side cylindrical body 81. Specifically, the structural member 109 is provided to be continuous to the upper surface of the inner wall of the female-side cylindrical body 81 over between the inner wall surfaces which face each other in the width direction of the female-side cylindrical body 81. The frame body 111 has guidance surfaces 113 each of which extends from the inner surface which partitions the quadrilateral opening 77 to be inclined to the front side in the vertical and horizontal direction. Each of the guidance surfaces 113 is continuous to a foremost end 115 of the structural member 109. Incidentally, the guidance surface 113 has a function to guide the male tap 67 into the opening 77.

In this embodiment, the projection 105 is provided on the front end side of the female-side cylindrical body 81 from the foremost end 115 of the structural member 109. Thus, the inside of the female-side cylindrical body 81 is formed to be hollow (caved) at least from the inside of the projection 105 to the front end.

Figure 9A:
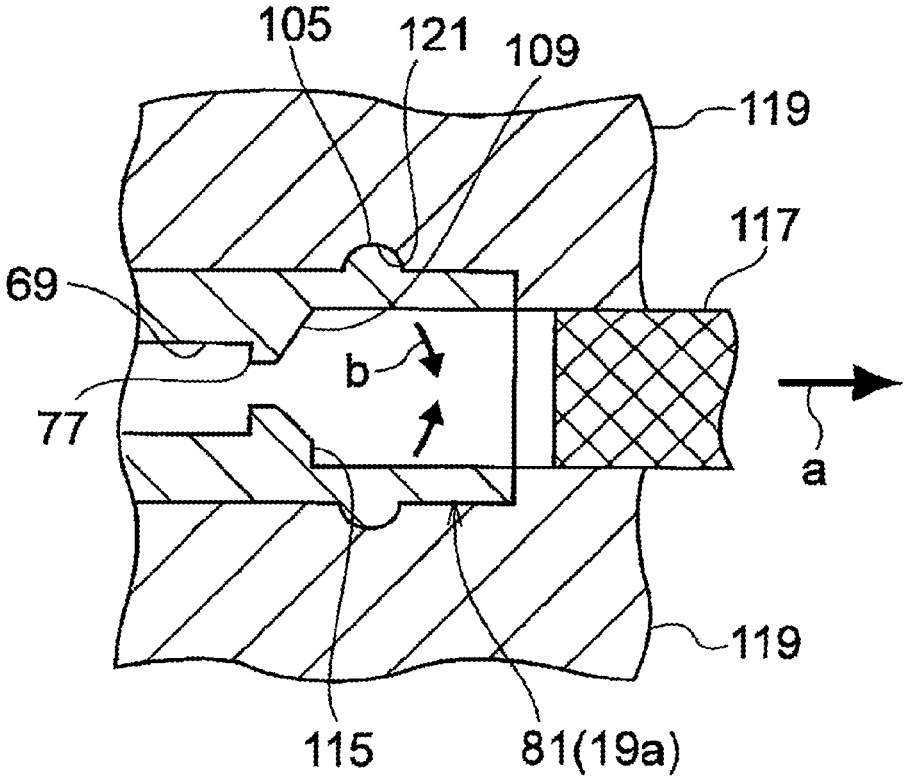

FIG. 9A is a schematic view explaining for an operation of extracting the female housing 19 (hereinafter, referred to as a molded body 19*a* as appropriate.) from the mold at the time of molding the female housing 19 of this embodiment. In the drawing, reference numeral 117 indicates an insert (first mold component) of the mold which forms the inner wall 101 of the female-side cylindrical body 81, and reference numeral 119 indicates an insert (a second mold component) of the mold which forms an outer wall 103 including the projection 105 of the female-side cylindrical body 81. The insert 117 is formed in a columnar shape to have an outer circumferential surface corresponding to the inner wall 101, and the insert 119 is formed in a cylindrical shape to have the inner circumferential surface corresponding to the outer wall 103.

In the operation of extracting the molded body 19*a* from the mold, resin is filled in the mold to cure the molded body 19, and then the insert 117 is extracted from the molded body

19*a* (female-side cylindrical body 81) held in the mold in the direction of an arrow a. Moreover, in a state where the molded body 19*a* is held in the mold, the insert 119 is extracted from the molded body 19*a* (female-side cylindrical body 81) in the same direction as that of the insert 117, and finally the molded body 19*a* is released from the mold.

In the operation, in the molded body 19*a* from which the insert 117 is extracted, the inside of the female-side cylindrical body 81 is caved from the position where the projection 105 is provided to the front end of the female-side cylindrical body 81, that is, from the foremost end 115 of the structural member 109 to the front end, and there is not provided a member which obstructs the deformation (including a shrinkage at the time of cooling) of the female-side cylindrical body 81 toward the inside, for example, a member which is provided over between the facing inner walls of the female-side cylindrical body 81. For this reason, when the insert 119 is extracted, in the molded body 19*a*, the female-side cylindrical body 81 is bent to the inside (the direction of the arrow b) in the form of being pushed to the inside by the insert 119. As a result, the projection 105 is deviated from a recess part 121 of the insert 119, which forms the projection 105. Therefore, the molded body 19*a* does not have a portion (shape) which is caught in the extracting direction of the mold at the time of releasing. Thus, the projection 105 is released without being caught by the mold, and it is possible to prevent the breakage of the projection shape. Incidentally, the female-side cylindrical body 81 which has been bent to the inside returns to an original shape after releasing.

Figure 9B:
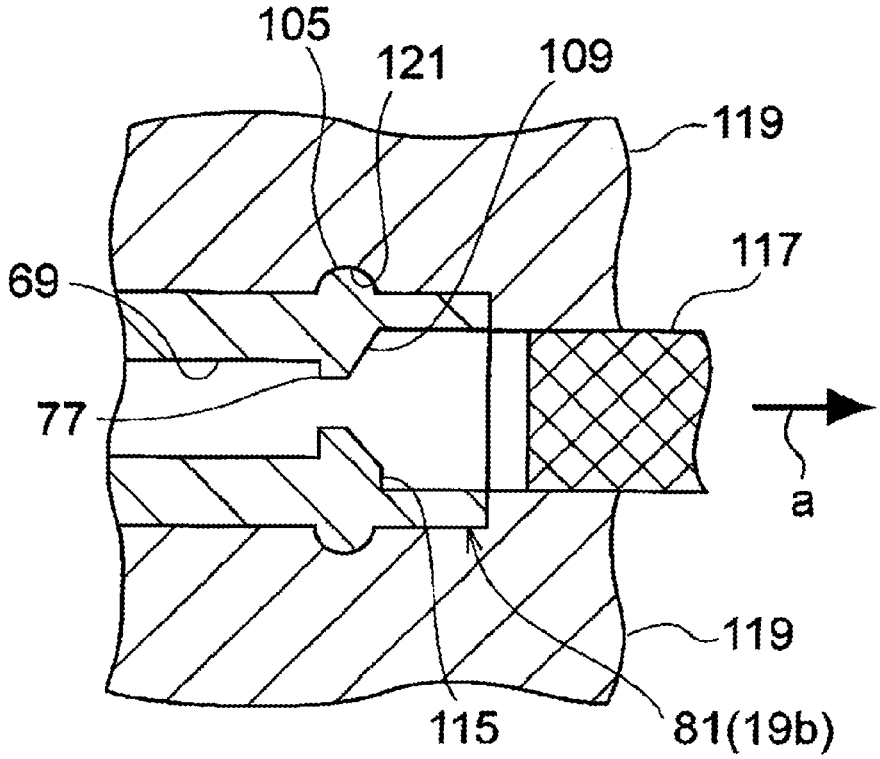

With respect thereto, as a molded body 19*b* of FIG. 9B, in a case where the projection 105 is not provided on the front end side of the female-side cylindrical body 81 from the foremost end 115 of the structural member 109, it is obstructed that the structural member 109 is bent to the inside of the female-side cylindrical body 81 when the insert 119 is extracted. Thus, the projection 105 is hardly deviated from the recess part 121 of the insert 119. Therefore, when the molded body 19*b* is extracted from the mold, there is a concern that the projection 105 is caught by the recess part 121, and the projection shape is broken.

As described above, in this embodiment, the projection 105 is provided on the front end side of the female-side cylindrical body 81 from the foremost end 115 of the structural member 109 supported in the inner wall of the female-side cylindrical body 81. Thus, the projection 105 can be deviated from the recess part 121 of the mold by shifting the timing of extracting the inserts 117 and 119 of the mold, and the molded body 19*a* can be extracted from the mold without the breakage of the shape of the projection 105. Therefore, the projection 105 can be positioned to the root side of the female-side cylindrical body 81, and the waterproof property can be improved further.

Herein, for example, the projection 105 is set to be provided a set dimension apart from the foremost end 115 of the structural member 109 on the front end side of the female-side cylindrical body 81. When the insert 117 is extracted from the inside of the female-side cylindrical body 81, and then the insert 119 is extracted from the mold in a state where the female housing 19 is held in the mold, the female-side cylindrical body 81 is bent to the inside so that the projection 105 is deviated from the recess part 121 of the mold by a distance, which is the set dimension. Specifically, the set dimension can be decided on the basis of at least one selected from the height of the projection 105, the shrinkage amount of the projection 105, the thickness and the diameter dimension of the female-side cylindrical body 81, or the like.

Hereinbefore, the embodiment of the invention is described in detail by using the drawings. However, the embodiment is merely presented as an example of the invention, and may be modified or deformed within the range described in claims.

For example, in this embodiment, the structural member 109 is provided inside the female-side cylindrical body 81. However, the structural member 109 may be provided to be supported by the front end surface 75 of the base part 71 of the female housing 19. In addition, the structural member 109 of this embodiment has such a shape that is formed to be continuous to the upper surface of the inner wall of the female-side cylindrical body 81 over between the inner wall surfaces which face each other in the width direction of the female-side cylindrical body 81, so as to obstruct the deformation of the female-side cylindrical body 81 to the inside. However, the shape is not limited particularly as long as the structural member is provided at least over between the inner wall surfaces which face each other in the width direction of the female-side cylindrical body 81 or is provided in the circumferential direction of the inner wall including the corner portion of the female-side cylindrical body 81.

The projection 105 of this embodiment is not limited to a case where the sectional surface in the axial direction of the female-side cylindrical body 81 is formed in a trapezoidal shape, and may be formed such that the sectional surface has a semi-arc shape. In this case, when the female-side cylindrical body 81 is released from the mold, the projection 105 is easily deviated from the recess part 121 of the mold. Thus, the breakage of the shape of the projection can be prevented more reliably.

Herein, the features of the embodiments of the waterproof connector structure and the method for producing the connector housing according to the invention will be simply summarized as the following (1) to (3).

(1) A waterproof connector structure including: a pair of connector housings (17, 19) fittable to each other and capable of preventing water from entering a terminal receiving chamber (29, 69) through an opening part (47, 77) on a front side of the terminal receiving chamber of the connector housing in a fitting direction at a time of fitting the pair of connector housings, wherein each of the pair of connector housings includes a cylindrical body (51, 81) which surrounds the opening part (47, 77) and in which a front side in the fitting direction is opened, and is configured such that an opening end portion of one cylindrical body (51) is inserted into an opening end portion of another cylindrical body (81) at the time of fitting the pair of connector housings, and wherein the one cylindrical body (51) includes a projection part (105) which is provided on the opening end portion of the one cylindrical body entirely in a circumferential direction to protrude outward from the opening end portion of the one cylindrical body in a radial direction so as to contact the opening end portion of the another cylindrical body (81), the projection part (105) being provided on the front side in the fitting direction from the opening part (77) of the terminal receiving chamber (69) surrounded by the one cylindrical body (51).

(2) The waterproof connector structure according to (1), wherein the projection part (105) has a semi-arc shape or a trapezoidal shape in a cross-section perpendicular to the fitting direction.

(3) A method for producing a connector housing including a terminal receiving chamber (69), the connector housing (19) including a cylindrical body (81) which surrounds an opening part (77) of the terminal receiving chamber, and the cylindrical body including a projection part (105) which is provided on an opening end portion of the cylindrical body entirely in a circumferential direction to protrude outward from the opening end portion of the cylindrical body in a radial direction, the projection part (105) being provided on an opening end side from the opening part (77) of the terminal receiving chamber, the production method including:

a first process of filling a resin into a mold and curing a molded body of the connector housing;

a second process of extracting a first mold component which forms an inner wall of the cylindrical body of the molded body from the molded body while holding the molded body in the mold;

a third process of extracting a second mold component which forms an outer wall including the projection part of the cylindrical body of the molded body from the molded body while holding the molded body in the mold; and a fourth process of releasing the molded body from the mold.

According to the waterproof connector structure and the method for producing the connector housing of the invention, it is possible to reduce the insertion force at the time of inserting one of both housings to the other and to secure an excellent waterproof performance. The invention with such an effect is effectively applied to the waterproof connector structure and the method for producing the connector housing.

The invention claimed is:

1. A waterproof connector structure comprising:

a pair of connector housings fittable to each other and capable of preventing water from entering a terminal receiving chamber through an opening part on a front side of the terminal receiving chamber of one of the connector housings in a fitting direction at a time of fitting the pair of connector housings, wherein each of the pair of connector housings comprises a cylindrical body which surrounds the opening part and in which a front side in the fitting direction is opened, and is configured such that an opening end portion of one cylindrical body is inserted into an opening end portion of another cylindrical body at the time of fitting the pair of connector housings, wherein the one cylindrical body comprises a projection part which is provided on the opening end portion of the one cylindrical body entirely in a circumferential direction to protrude outward from the opening end portion of the one cylindrical body in a radial direction so as to contact the opening end portion of the another cylindrical body, the projection part being provided on the front side in the fitting direction from the opening part of the terminal receiving chamber surrounded by the one cylindrical body, wherein the one of the connector housings comprises a hood part inside which the another cylindrical body is contained, and wherein, when the pair of connector housings are fitted to each other, a hollow space is provided between the another cylindrical body and the hood part to allow a tip part of the another cylindrical body to elastically deform outward in the radial direction.

2. The waterproof connector structure according to claim 1, wherein the projection part has a semi-arc shape or a trapezoidal shape in a cross-section perpendicular to the fitting direction.

3. The waterproof connector structure according to claim 1, wherein both of the cylindrical bodies are contained within the respective one of the connector housings at the time of fitting the pair of connector housings.

4. The waterproof connector structure according to claim 1, further comprising a male terminal mounted in the terminal receiving chamber, the male terminal extends through the opening part on the front side of the terminal receiving chamber and outside of the terminal receiving chamber, and the male terminal extends through the another cylindrical body.

5. The waterproof connector structure according to claim 4, wherein the male terminal extends beyond the opening end portion of the one cylindrical body.

* * * * *